US006062229A

United States Patent [19]

Kandratavich et al.

[11] Patent Number: 6,062,229

[45] Date of Patent: May 16, 2000

[54] APPARATUS FOR REMOVING NAIL POLISH

[76] Inventors: Melinda Kandratavich; Melissa Kandratavich, both of 237 Summit House, West Chester, Pa. 19382

[21] Appl. No.: 09/272,007

[22] Filed: Mar. 18, 1999

[51] Int. Cl.[7] ..... A45D 29/05

[52] U.S. Cl. ..... 132/73.6; 132/73; 132/74.5; 15/24; 15/29

[58] Field of Search ..... 132/73.6, 73, 74.5, 132/75, 73.5, 75.8; 15/24, 29, 97.1; 401/122, 126, 129

[56] References Cited

U.S. PATENT DOCUMENTS

| | | | |
|---|---|---|---|
| 3,892,004 | 7/1975 | Downes | 15/24 |
| 3,943,591 | 3/1976 | Lanusse | 15/29 |
| 3,968,789 | 7/1976 | Simoncini | 15/29 |
| 4,255,826 | 3/1981 | Boyd . | |
| 4,510,954 | 4/1985 | Miller | 132/75 |
| 4,800,606 | 1/1989 | Kolesky | 132/73.6 |
| 5,007,441 | 4/1991 | Goldstein | 132/73.6 |
| 5,044,035 | 9/1991 | Barradas . | |
| 5,139,036 | 8/1992 | Pickard | 132/73.5 |
| 5,423,102 | 6/1995 | Madison | 15/29 |
| 5,649,334 | 7/1997 | Henriquez et al. | 15/29 |
| 5,881,418 | 3/1999 | Enoch | 15/29 |

*Primary Examiner*—Gene Mancene
*Assistant Examiner*—Pedro Philogene
*Attorney, Agent, or Firm*—Gary M. Cohen

[57] ABSTRACT

An apparatus for removing nail polish which generally includes a curved, substantially cylindrical housing having dimensions and a shape which is conveniently and comfortably grasped by the user and which receives the various operating components of the apparatus including a rotatable brush which projects from an end of the housing, and a motor for rotating the brush responsive to an actuating switch located along the surface of the housing. The motor is preferably battery-operated so that the apparatus is made portable and maneuverable. A reservoir is further provided to contain a polish-removing solution, and a fluid dispenser is provided to deliver desired amounts of the solution from the reservoir to the brush. The solution is advantageously dispensed into center portions of the brush so that the solution need not be applied to the brush or to the nails. Instead, the solution is caused to permeate from the center of the brush to its surface so that a minimal amount of solution is exposed for use, in this way avoiding the potential for excess quantities of fluid to be discharged from the brush, and the apparatus, while in use.

18 Claims, 2 Drawing Sheets

APPARATUS FOR REMOVING NAIL POLISH

BACKGROUND OF THE INVENTION

The present invention relates generally to an apparatus for promoting nail care, and more particularly, to a motor driven apparatus for facilitating the removal of nail polish coatings from the nails.

Maintaining healthy and attractive nails has become an important aspect of beauty and fashion, and the ever-increasing interest in maintaining personal hygiene and in putting forth a neat and professional appearance. Recognizing this need, any of a number of companies have come to manufacture a host of nail polishes, and products associated with their application.

The application of nail polish is a relatively simple procedure which is typically performed manually, by brush. However, the process is generally time-consuming and results can vary. Moreover, the application process can at times be relatively messy.

Subsequent removal of the applied nail polish is even more problematic, since solvents are generally required as part of the process. Such removal is also typically performed manually, using cotton balls that have been permeated with a polish removing fluid. Frequently, during this removal process, skin and clothes are inadvertently stained by the removed polish, which attains a liquid or semi-liquid state responsive to the application of the polish removing fluid.

In an effort to make the process of removing nail polish more convenient, mechanized devices have been developed to facilitate polish removal. For example, U.S. Pat. No. 5,007,441 (Goldstein) and U.S. Pat. No. 4,255,826 (Boyd) disclose devices having a cavity for receiving the nails, and brushes and/or solution contained within the cavity for causing the nail polish to be removed. However, such devices have not proven favorable since the enclosures developed for receiving the nails tend to prevent the user from adequately viewing and controlling the polish removing process.

The need therefore remains to develop an apparatus which can be used to simply and effectively remove nail polish without also producing messy by-products tending to stain the user's hands and clothing.

Accordingly, it is the primary object of the present invention to develop an apparatus which can more efficiently remove nail polish.

It is also an object of the present invention to develop an apparatus which can efficiently remove nail polish in a less time-consuming manner.

It is also an object of the present invention to develop an apparatus which can quickly and efficiently remove nail polish without also producing messy by-products tending to stain the user's hands and clothing.

It is also an object of the present invention to develop an apparatus which can quickly and efficiently remove nail polish, and which is sufficiently simple to be used by the general consumer, as well as the salon professional.

SUMMARY OF THE INVENTION

These and other objects which will become apparent are achieved in accordance with the present invention by providing a nail polish removing apparatus which is generally comprised of a curved, substantially cylindrical housing having dimensions and a shape which is conveniently and comfortably grasped by the user and which includes the various operating components necessary for facilitating the removal of nail polish.

To this end, a brush or sponge is caused to project from an end of the housing, and is made rotatable by a motor which can be operated responsive to an actuating switch located conveniently along the surface of the housing. The motor is preferably battery-operated so that the resulting unit is made portable and maneuverable. However, if desired, the motor can also be operated using line current (e.g., cord-operated).

The brush is further placed in communication with a reservoir of polish-removing fluid, which is received within the housing to provide a fully self-contained apparatus having all of the features appropriate toward effective nail polish removal. The brush communicates with a metering device for dispensing desired amounts of the polish-removing solution from the reservoir to the brush.

The solution is dispensed into a receiving tube which preferably communicates with center portions of the brush so that fluid need not be applied to the brush or to the nails. Instead, the solution is caused to permeate from the center of the brush to its surface, so that a minimal amount of solution is exposed for use. This avoids the potential for excess quantities of solution to be discharged from the brush, and the apparatus, while in use.

For further detail regarding the nail polish removing apparatus of the present invention, reference is made to the detailed description which is provided below, taken in conjunction with the following illustrations.

DETAILED DESCRIPTION OF A PREFERRED EMBODIMENT

Figure 1:
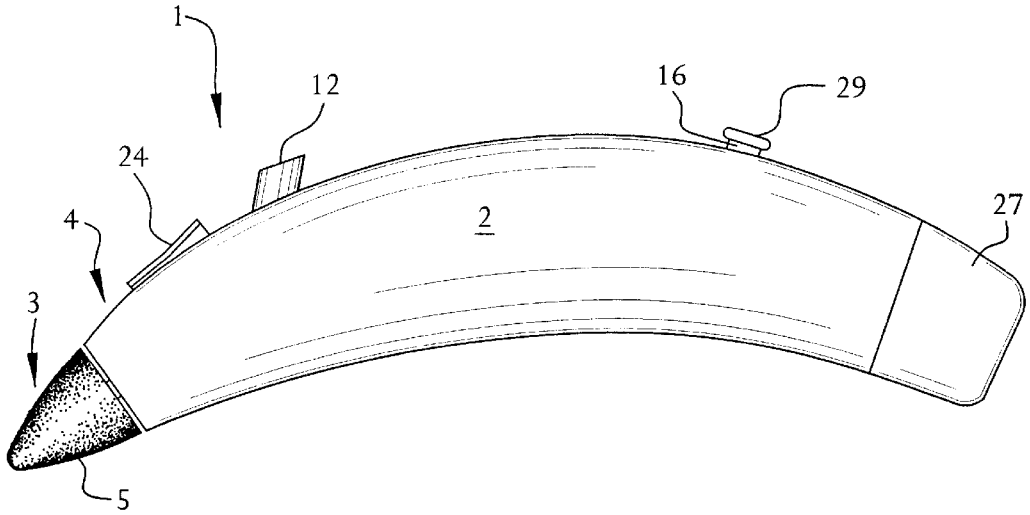
FIG. 1 is a side elevational view of the nail polish removing apparatus of the present invention.
Figure 2:
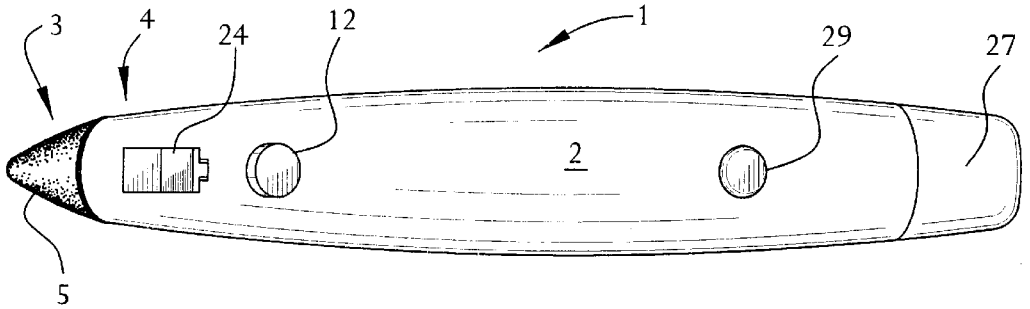
FIG. 2 is a top plan view of the nail polish removing apparatus of FIG. 1.

FIGS. 1 and 2 show a preferred embodiment of the nail polish removing apparatus 1 of the present invention. The apparatus 1 is generally defined by a housing 2 which contains the various operating components for facilitating the removal of nail polish as will be discussed more fully below.

The housing 2 is preferably formed of a resilient material, such as plastics, and can be manufactured using any of a variety of known processes. The use of plastic materials is presently preferred in view of their ease of manufacture and their resistance to damage. However, housings formed of other materials, such as metals, can also be fabricated where stronger materials are called for (e.g., for commercial applications).

The housing 2 is preferably curved, as shown in FIGS. 1 and 2, and is substantially cylindrical in cross section. This contoured shape is presently preferred for comfort and ease of use. However, housings having other shapes (and dimensions) which are conveniently and comfortably grasped by a user can alternatively be used.

A brush 3 projects from the forward end 4 of the housing 2 and, as will be discussed more fully below, is made rotatable to facilitate removal of polish from the user's nails. The brush 3 preferably takes the form of a sponge, made from a porous foam material. However, the brush 3 can alternatively be formed of a plurality of bristles, if desired.

In either case, the pores of the foam sponge or the bristles of the brush must be able to pass fluids from the center of the brush 3 to the surface 5 so that a polish-removing fluid received within the housing 2 can be delivered to the surface 5 of the brush 3 as will be discussed more fully below.

Figure 3:
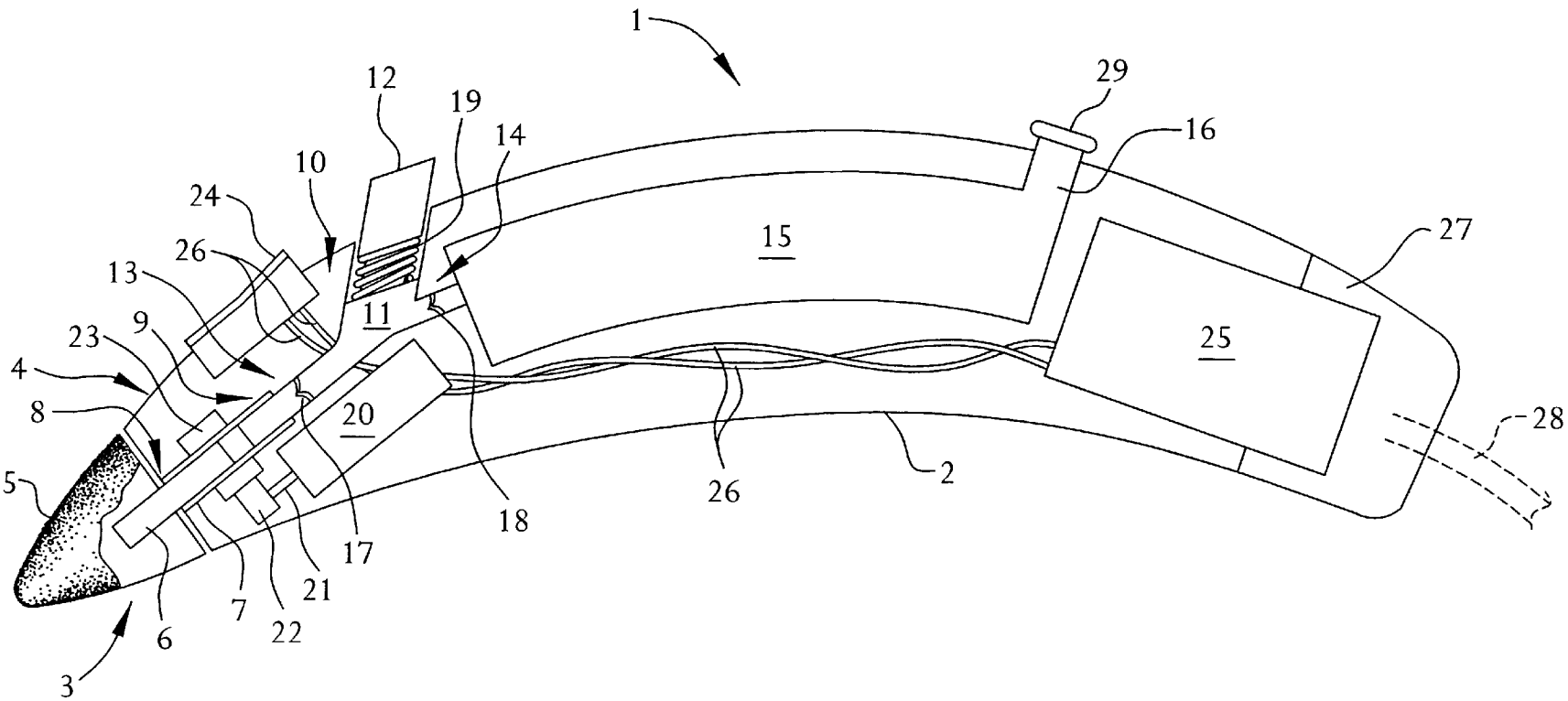
FIG. 3 is a partially sectioned, side elevational view of the nail polish removing apparatus of FIG. 1, with a side of the housing removed to show internal structure.

Referring now to FIG. 3, in conjunction with the illustrations of FIGS. 1 and 2, the operating components of the apparatus 1 will now be described.

The brush 3 is mounted on a fluid-delivering tube 6 which is open at both ends. The tube 6 is in turn received by a collar 7, which is also open at both ends. The proximal end 8 of the collar 7 is sized to receive the tube 6 of the brush 3. This can be accomplished using either a frictional fit or a locking fit, as preferred. The tube 6 and the collar 7 can also be keyed, if desired, to ensure a positive engagement between the two structures when fit together.

The distal end 9 of the collar 7 communicates with a mechanism 10 for dispensing fluids to the brush 3. To this end, the fluid-dispensing mechanism 10 generally includes a chamber 11 and a plunger 12. The proximal end 13 of the chamber 11 is received within the distal end 9 of the collar 7. The distal end 14 of the chamber 11 communicates with a fluid-receiving reservoir 15 which is contained within the housing 2 and which can be accessed through a filler opening 16 extending through the housing 2 to the interior of the reservoir 15.

The plunger 12 is slidingly received within upper portions of the chamber 11, extending upwardly from the housing 2 as shown. A sealing engagement is developed between the plunger 12 and the upper portions of the chamber 11 so that depression of the plunger 12 operates to pump fluid from the reservoir 15 to the brush 3. To this end, both the proximal end 13 and the distal end 14 of the chamber 11 are provided with one-way valves 17, 18.

In the embodiment illustrated, the one-way valves 17, 18 are implemented as diaphragms which allow fluid to pass forward (relative to the dispensing mechanism 10) but which prevent fluid from passing rearwardly. In this way, pressure placed on the plunger 12 operates to force fluid contained in the chamber 11 from the proximal end 13 (through the one-way valve 17) and into the communicating collar 7. A spring 19 is provided to bias the plunger 12 away from the chamber 11 so that upon release of the plunger 12, the plunger 12 is urged toward its fully extended position. Retraction of the plunger 12 causes a suction to develop within the chamber 11, against the resistance of the one-way valve 17, causing fluid to be drawn from the reservoir 15 (through the one-way valve 18) and into the chamber 11. The one-way valve 18 is biased to prevent fluid from returning to the reservoir 15 upon depression of the plunger 12, ensuring that the fluid is discharged from the proximal end 13 of the chamber 11 as previously described.

The amount of fluid which is in this way supplied to the brush 3 can be regulated in different ways to achieve different results. For example, by ensuring a free, sliding engagement between the plunger 12 and the chamber 11, the user is given free control of the amount of fluid to be dispensed, as needed. Alternatively, by causing the plunger 12 to engage a stop associated with the chamber 11, metered dosing of the amount of fluid delivered to the brush 3 can be achieved.

Rotation of the brush 3 is achieved responsive to a motor 20 received within the housing 2. The shaft 21 of the motor 20 receives a drive gear 22 which meshes with a gear 23 associated with the collar 7. The collar 7 is journalled for rotation about the proximal end 13 of the chamber 11 so that rotation of the motor 20 causes rotation of the brush 3 which is received by the collar 7. Operation of the motor 20 (and in this way, rotation of the brush 3) is regulated responsive to a switch 24 which is placed on the housing 2 for convenient access by the user. The switch 24 can either provide a basic on-off function, achieving single-speed operation, or if desired, can additionally be used to regulate the speed of rotation of the motor 20 (e.g., by implementing the switch 24 as a rheostat).

The motor 20 and the switch 24 are electrically connected to a battery 25 by suitable wires 26, completing the desired electrical circuit. The battery 25 can either be a rechargeable battery of known type, or a replaceable battery received within a suitable cradle. The housing 2 is preferably provided with a removable rear section 27, for accessing the battery 25 when servicing is required. As a further alternative, the battery 25 can be replaced by a power cord (shown in phantom at 28 in FIG. 3) in cases where the use of line (AC) current is desired.

Prior to use, a cap 29 associated with the filler opening 16 is removed to gain access to the reservoir 15. A desired quantity of a polish-removing solution is then introduced into the reservoir 15, and the cap 29 is replaced over the filler opening 16. For convenience, the polish-removing solution can be stored in a container and dispensed with an eye-dropper, and the size of the eye-dropper can be selected to deliver pre-measured amounts of fluid to the reservoir 15. A desired brush 3 (e.g., a sponge tip, either conical, rounded or flat) is inserted into the open, proximal end 8 of the collar 7, readying the apparatus 1 for use.

To this end, the switch 24 is used to operate (by gently rotating) the brush 3 and the plunger 12 is used to dispense desired amounts of polish-removing solution from the reservoir 15 to the brush 3. By dispensing the solution from a tube 6 which communicates with the center portions of the brush 3, the polish-removing solution need not be applied to the surface 5 of the brush 3 or directly to the nails. Instead, the polish-removing solution is caused to permeate from the center of the brush 3 to the surface 5, so that only minimal amounts of solution are exposed during use of the apparatus 1 (i.e., only the amount needed to wet the sponge with sufficient solution for cleaning away the nail polish, without splashing, dripping or spilling). This, in turn, avoids the potential for excess quantities of solution to be discharged from the brush 3, and the apparatus 1, while in use. As fluid is removed from the brush 3 (i.e., as the sponge dries out), additional solution can be pumped to the brush 3 by placing pressure on the plunger 12. Because the solution is discharged from the center of the brush 3, this can even be accomplished while the brush 3 is rotating. This avoids the need to have to discontinue operation of the brush 3 during the polish-removing procedure. The reservoir 15 is preferably sized to contain sufficient solution to clean the polish from all of the user's nails without the need to refill the reservoir 15 during such use.

Following use, the apparatus 1 can be used to clean the sponge 3, for future use, by causing the brush 3 to rotate in a cleaning solution (of the nail polish removing fluid). If the apparatus 1 employs a rechargeable battery 25, as previously described, the housing is then preferably placed and stored in the cradle of a suitable recharging device, so that the apparatus 1 will be ready for future use.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. An apparatus for removing polish from nails, comprising:

a housing defining an enclosure for receiving operative components of the apparatus, wherein the housing is curved in contour and substantially circular in cross-section;

a reservoir positioned within the housing, for receiving a nail polish removing solution therein;

a fluid dispenser in fluid communication with the reservoir, for receiving the solution from the reservoir and for dispensing the solution to the brush;

a collar in fluid communication with the fluid dispenser, wherein the collar is journalled for rotation within the housing;

a motor operatively coupled with the collar, for causing the rotation of the collar within the housing; and a brush having a center and formed of a porous foam material having a porosity sufficient to pass the solution from the center of the brush to surface portions of the brush, wherein the brush includes a fluid-delivering tube having a single aperture in fluid communication with the center of the brush, wherein the tube engages the collar, for rotation with the collar responsive to the motor, and wherein the tube is in fluid communication with the collar, for receiving the solution from the fluid dispenser and for delivering the solution to the center of the brush.

2. The apparatus of claim 1 wherein the brush has a surface which is conical in shape.

3. The apparatus of claim 1 wherein the brush has a surface which is rounded in shape.

4. The apparatus of claim 1 wherein the brush has a surface, portions of which are flat.

5. The apparatus of claim 1 wherein the motor includes a drive gear for engaging a gear surrounding the collar, for rotating the collar responsive to operation of the motor.

6. The apparatus of claim 5 wherein the motor is battery-operated.

7. The apparatus of claim 5 wherein the motor is cord-operated.

8. The apparatus of claim 1 wherein the motor is rotated at a fixed, constant speed.

9. The apparatus of claim 1 wherein the motor is rotated at a selected speed, and wherein the apparatus further includes means for varying the rotational speed of the motor.

10. The apparatus of claim 1 wherein the fluid dispenser includes a fluid-receiving chamber, and a plunger operatively coupled with the chamber to dispense the solution from the chamber.

11. The apparatus of claim 10 wherein the fluid dispenser further includes a proximal end in fluid communication with the brush and a distal end coupled with the reservoir.

12. The apparatus of claim 11 which further includes a first one-way valve positioned within the proximal end of the chamber and a second one-way valve positioned within the distal end of the chamber.

13. The apparatus of claim 12 wherein the first one-way valve and the second one-way valve are formed as diaphragms.

14. The apparatus of claim 12 wherein the first one-way valve is positioned within the proximal end of the chamber so that the solution is only movable from the chamber to the brush.

15. The apparatus of claim 14 wherein the second one-way valve is positioned within the distal end of the chamber so that the solution is only movable from the reservoir to the chamber.

16. The apparatus of claim 10 wherein the fluid dispenser further includes a spring coupled with the plunger to bias the plunger into a retracted position extending from the housing.

17. The apparatus of claim 10 wherein the housing includes a switch electrically coupled with the motor, for selectively operating the motor, and wherein the switch and the plunger are positioned on the housing and adjacent to each other.

18. The apparatus of claim 1 wherein the reservoir further includes a filler opening in fluid communication with the reservoir and extending from the reservoir, through the housing to exterior portions of the apparatus.

* * * * *